US007857713B2

(12) United States Patent
Yokota

(10) Patent No.: US 7,857,713 B2
(45) Date of Patent: Dec. 28, 2010

(54) WOOD-TYPE GOLF CLUB HEAD

(75) Inventor: Masatoshi Yokota, Kobe (JP)

(73) Assignee: SRI Sports Limited, Kobe (JP)

( * ) Notice: Subject to any disclaimer, the term of this patent is extended or adjusted under 35 U.S.C. 154(b) by 238 days.

(21) Appl. No.: 11/896,759

(22) Filed: Sep. 5, 2007

(65) Prior Publication Data

US 2008/0096688 A1 Apr. 24, 2008

(30) Foreign Application Priority Data

Oct. 19, 2006 (JP) ..... 2006-285347

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

U.S. PATENT DOCUMENTS

| | | | | |
|---|---|---|---|---|
| 5,681,228 | A * | 10/1997 | Mikame et al. | 473/330 |
| 5,935,020 | A * | 8/1999 | Stites et al. | 473/345 |
| 6,254,494 | B1 * | 7/2001 | Hasebe et al. | 473/349 |
| 6,340,337 | B2 * | 1/2002 | Hasebe et al. | 473/349 |
| 6,344,002 | B1 * | 2/2002 | Kajita | 473/330 |
| 6,425,832 | B2 * | 7/2002 | Cackett et al. | 473/345 |
| 6,572,491 | B2 * | 6/2003 | Hasebe et al. | 473/349 |
| 6,679,786 | B2 * | 1/2004 | McCabe | 473/305 |
| 6,716,114 | B2 * | 4/2004 | Nishio | 473/314 |
| 6,875,130 | B2 * | 4/2005 | Nishio | 473/345 |
| 6,913,546 | B2 * | 7/2005 | Kakiuchi | 473/345 |
| 7,077,762 | B2 * | 7/2006 | Kouno et al. | 473/314 |
| 7,131,912 | B1 * | 11/2006 | Knuth | 473/342 |
| 7,163,468 | B2 * | 1/2007 | Gibbs et al. | 473/329 |
| 7,300,360 | B2 * | 11/2007 | Oyama | 473/314 |
| 7,396,297 | B2 * | 7/2008 | Hirano | 473/345 |
| 7,479,070 | B2 * | 1/2009 | Hirano | 473/345 |
| 2006/0172819 | A1 * | 8/2006 | Sano | 473/345 |

FOREIGN PATENT DOCUMENTS

| | | | |
|---|---|---|---|
| JP | 57-1360 A | | 1/1982 |
| JP | 03070584 A | * | 3/1991 |
| JP | 08024376 A | * | 1/1996 |
| JP | 08089603 A | * | 4/1996 |

(Continued)

*Primary Examiner*—Alvin A Hunter
(74) *Attorney, Agent, or Firm*—Birch, Stewart, Kolasch & Birch, LLP

(57) ABSTRACT

A hollow wood-type golf club head 1 having a volume of 420 to 500 $cm^3$ and comprising face portion 3, wherein the face portion 3 comprises a metallic material having a specific gravity of 4.30 to 4.60 and has a thickness of 1.5 to 4.0 mm, and in the standard state of head 1, the X/Y ratio is 0.0070 or less in which X is the depth (mm) of the club head's center of gravity which is a horizontal length between the center of gravity and a sweet spot on face 2 in the front-rear direction of head 1, and Y is the moment of inertia ($g \cdot cm^2$) of head 1 about the vertical axis passing through the center of gravity, and the intersection line of the face 2 with a horizontal plane including the sweet spot is convex toward the front of head 1 and has a radius of curvature of 330.2 to 457.2 mm.

28 Claims, 10 Drawing Sheets

FOREIGN PATENT DOCUMENTS

| | | | | |
|---|---|---|---|---|
| JP | 08196665 | A | * | 8/1996 |
| JP | 08308962 | A | * | 11/1996 |
| JP | 9-140836 | A | | 6/1997 |
| JP | 09140836 | A | * | 6/1997 |
| JP | 11033145 | A | * | 2/1999 |
| JP | 11178956 | A | * | 7/1999 |
| JP | 2000084124 | A | * | 3/2000 |
| JP | 2000116823 | A | * | 4/2000 |
| JP | 2000167089 | A | * | 6/2000 |
| JP | 2000300701 | A | * | 10/2000 |
| JP | 2001161866 | A | * | 6/2001 |
| JP | 2001190715 | A | * | 7/2001 |
| JP | 2001231888 | A | * | 8/2001 |
| JP | 2001321466 | A | * | 11/2001 |
| JP | 2002078832 | A | * | 3/2002 |
| JP | 2002210047 | A | * | 7/2002 |
| JP | 2002-224247 | A | | 8/2002 |
| JP | 2002325867 | A | * | 11/2002 |
| JP | 2002360746 | A | * | 12/2002 |
| JP | 2003320061 | A | * | 11/2003 |
| JP | 2004195005 | A | * | 7/2004 |
| JP | 2004-261451 | A | | 9/2004 |
| JP | 2004261451 | A | * | 9/2004 |
| JP | 2006-212092 | A | | 8/2006 |

* cited by examiner ( Com. Ex. 4 and Examples 1 to 4 )

( Example 5 )

WOOD-TYPE GOLF CLUB HEAD

BACKGROUND OF THE INVENTION

The present invention relates to a wood-type golf club head having an improved flight direction performance for hit ball.

In order to improve the flight direction performance of a wood-type golf club head, it is proposed to increase the moment of inertia (to be exact, the moment of inertia of a club head about the vertical axis passing through the center of gravity of the club head). That is to say, a gear effect produced by off-center hit that a golf ball has hit a club head outside a sweet spot of the club head, for example, near the toe or heel of the club head, is suppressed by increasing the moment of inertia, whereby the side spin amount of the struck golf ball is decreased to stabilize the direction performance.

The gear effect produced when hitting a golf ball by a right-handed golfer is briefly explained below (all explanations made herein being for right-handed golfers). For example, if a golf ball "b" is struck by a club head "a" at a position on the toe side of the club face as shown in FIG. 10(A), the club head "a" rotates clockwise about the club head's center of gravity by a force receiving from the ball. Since the ball "b" and the club face are in contact with each other at that time, a side spin which causes the ball to rotate in the counterclockwise direction which is opposite to the rotation of the club head "a" (so-called hook spin) is imparted to the ball "b" by a frictional force between the ball and the face. Therefore, the ball tends to curve toward the left of the intended line of flight. Such an action is called "gear effect" with likening the head "a" and the ball "b" to a pair of engaged gears. When the club head strikes the ball "b" on a heel hit as shown in FIG. 10(B), a gear effect of the reverse rotation to the hook spin is produced to impart a side spin of the clockwise rotation (so-called slice spin) to the ball "b". The slice spin tends to cause the ball to curve toward the right of the intended line of flight.

In order to improve the directionality for the hit ball, it is also proposed to make the depth of the center of gravity small, as disclosed in JP 9-140836 A and U.S. Pat. No. 6,913,546 B2. The depth of the center of gravity is a horizontal length between the center of gravity of the head and the sweet spot on the face of the head in the front-rear direction of the head. The moment rotating the club head around the center of gravity on an off-center hit increases as the depth of the center of gravity increases. Therefore, if the depth of the center of gravity is large, the gear effect becomes large and the side spin amount of the hit ball tends to increase. In improving the directionality of hit ball by suppressing the gear effect, it is desirable to decrease the depth of the center of gravity.

In JP 9-140836 A, it is proposed to decrease the depth of the center of gravity by thickening the face portion of the head. However, a thick face portion may deteriorate the repellency of the face portion to reduce the flight distance of ball. Further, since the proposed club head has a volume of 220 to 320 $cm^3$, it is inferred that the moment of inertia of the head is small and, of course, no consideration is given to a relationship between the depth of the center of gravity and the moment of inertia.

In U.S. Pat. No. 6,913,546 B2, it is proposed to decrease the depth of the center of gravity by using a metallic material having a high specific gravity as a material for preparing the face portion of the head. However, the use of a metallic material having a high specific gravity has a limit in increasing the head volume and, for example, it is difficult to produce club heads having a volume of 420 $cm^3$ or more. Further, since the face portion is heavy, it is required for increasing the moment of inertia to dispose a heavier material at a peripheral portion of the head, whereby the head weight becomes too large, so the head speed during the swing is lowered and it becomes difficult to perform the swing to impair the directional stability.

It is an object of the present invention to provide a wood-type golf club head having an improved directional stability without lowering the flight distance of hit ball.

This and other objects of the present invention will become apparent from the description hereinafter.

SUMMARY OF THE INVENTION

In accordance with the present invention, there is provided a hollow wood-type golf club head comprising a face portion having a hitting face for hitting a golf ball on its front side, and having a head volume of 420 to 500 $cm^3$, wherein:

the face portion is made of a metallic material having a specific gravity of 4.30 to 4.60 and has a thickness of 1.5 to 4.0 mm, in the standard state that the club head is placed on a horizontal plane at prescribed lie and loft angles, the X/Y ratio is 0.0070 or less in which X is the depth (mm) of the center of gravity of the club head which is a horizontal length between the center of gravity and a sweet spot on the hitting face in the front-rear direction of the club head, and Y is the moment of inertia ($g \cdot cm^2$) of the club head about the vertical axis passing through the center of gravity, and the fitting face is convexly curved such that an intersection line of the fitting face and a horizontal plane including the sweet spot is convex toward the front of the head, and the radius of curvature Rc of the convex intersection line is from 330.2 to 457.2 mm.

Preferably, the face progression of the club head is from 10 to 22 mm.

Preferably, the hitting face is a multi-radius face such that the radius of curvature on the heel side of the above-mentioned intersection line (i.e., horizontal face bulge) is larger than the radius of curvature on the toe side of the intersection line.

In a preferable embodiment, the club head comprises a head body and a face member which constitutes a main part of the face portion and is fixed to the head body, in which the face member is produced from a first titanium alloy and the head body is produced from a second titanium alloy having a larger specific gravity than that of the first titanium alloy.

Preferably, the first titanium alloy has a Young's modulus of 120 to 150 GPa and a tensile strength of 950 to 2,200 MPa. A preferable first titanium alloy is a Ti—Al—Fe alloy containing 4.5 to 5.5% by weight of aluminum, 0.5 to 1.5% by weight of iron, and the remaining amount of titanium and unavoidable impurities.

In the wood-type golf club heads of the present invention, the face portion is formed to have a specific gravity and a thickness within specified ranges as mentioned above. Therefore, the club heads can be prepared to have a large head volume while preventing deterioration of the repellency of the face portion. This is effective for increasing the moment of inertia to thereby stabilize the flight direction performance. In the present invention, the X/Y ratio of the depth X (mm) of the center of gravity to the moment of inertia Y ($g \cdot cm^2$) about the vertical axis passing through the center of gravity is set to suppress the gear effect and, therefore, the amount of side spin imparted to a ball by off-center hit can be decreased to improve the directional stability for hit ball.

Rotation of the club head on an off-center hit opens or closes the face of the club head and causes the ball to fly initially to the right or left of the intended line of flight, and the hook or slice spin imparted by the gear effect causes the ball to curve back toward the intended line of flight. Usually the gear effect spin is excessive and the ball would hook to the left or slice to the right of the intended line of flight. In the present invention, the club head is designed to suppress the side spin amount of hit ball and, therefore, the hitting face of the club head of the present invention is provided with a horizontal bulge having a large radius of curvature.

DETAILED DESCRIPTION

An embodiment of the present invention will be explained below with reference to the accompanying drawings.

Figure 1:
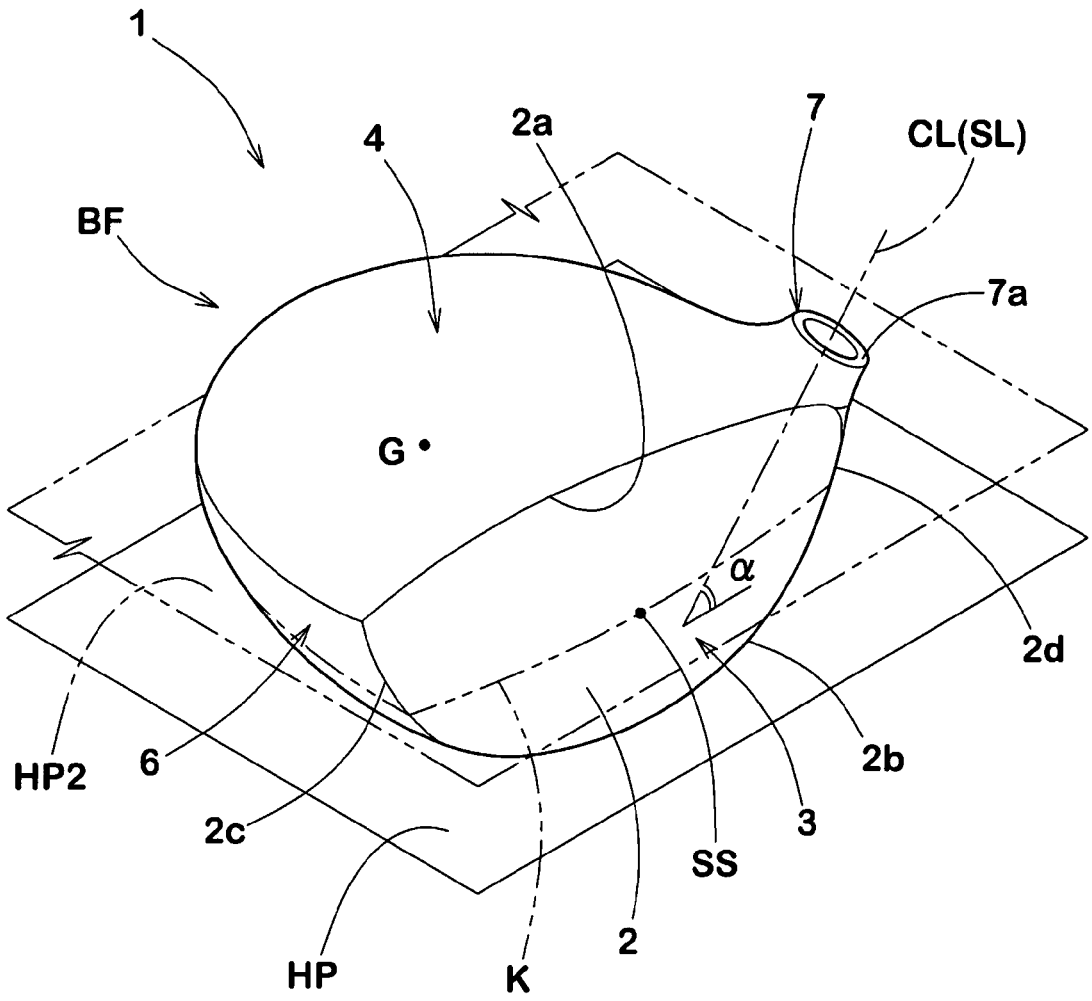
FIG. 1 is a perspective view of a golf club head showing an embodiment of the present invention.
Figure 2:
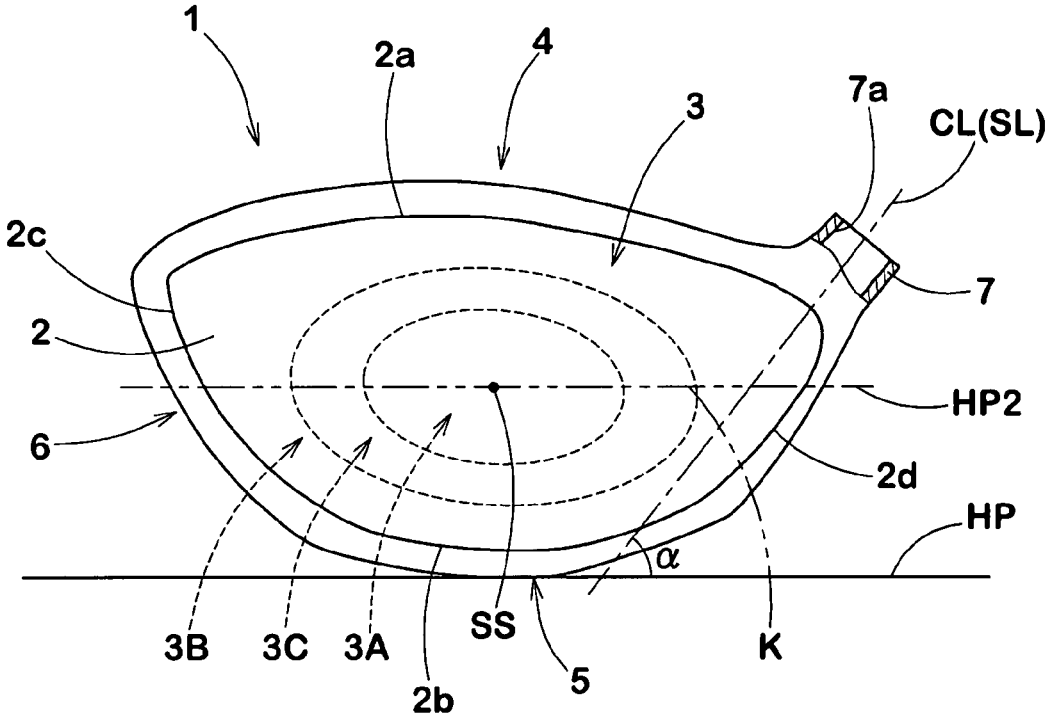
FIG. 2 is a front view of the club head of FIG. 1.
Figure 3:
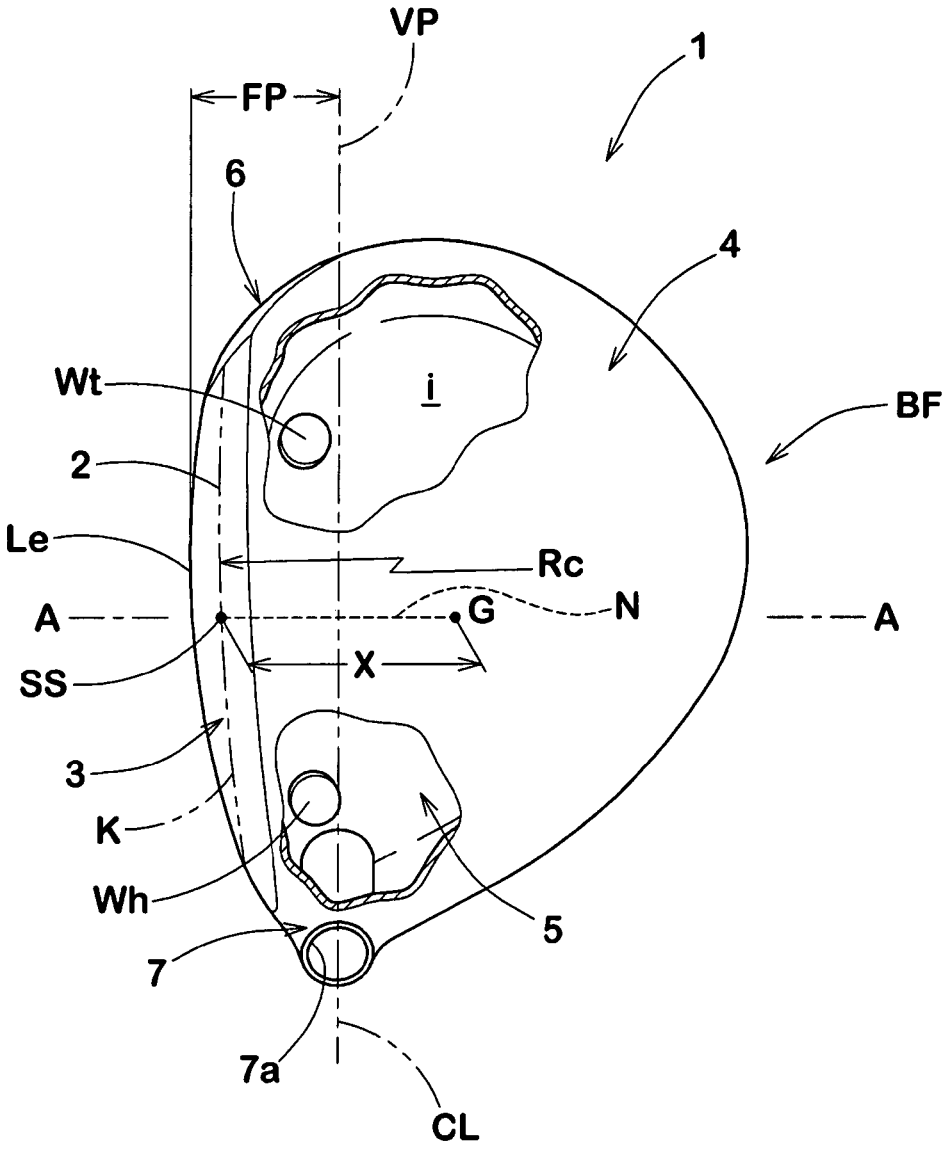
FIG. 3 is a partially broken plan view of the club head of FIG. 1.

FIGS. 1 to 4 are perspective, front and plane views of a wood-type golf club head 1 in the standard state according to an embodiment of the present invention, and a cross sectional view along the line A-A of FIG. 3, respectively.

The term "standard state" of a golf club head as used herein denotes the state that golf club head 1 is placed on a horizontal plane HP in the state that an axial center line SL of a shaft is disposed in an optional vertical plane VP and is inclined at a lie angle $\alpha$ given to the head 1 with respect to the horizontal plane HP, and a hitting face 2 is inclined at a loft angle $\beta$ (real loft angle) given to the head 1 (the face angle being set to zero). The head 1 referred to herein is in the standard state unless otherwise noted.

Further, with respect to the club head 1, the up-down direction and the height direction denote those of the club head 1 in the standard state. The front-rear direction denotes, when the head 1 in the standard state is viewed from above, namely in a plane view of the head 1 (FIG. 3), a direction which is parallel to a perpendicular line N drawn from the club head center of gravity G to the face 2, and a face 2 side is the front and a back face BF side is the rear or back. The toe-heel direction of the club head 1 denotes a direction which is perpendicular to the front-rear direction in the plane view of the head 1. In the drawings, the mark "SS" denotes a sweet spot which is a point where a normal line N drawn to the face 2 from the center of gravity G of the head 1 intersects the face 2.

The wood-type golf club head 1 includes a face portion 3 having a face 2 having a smooth curved surface for hitting a golf ball on its front side, a crown portion 4 which extends from the upper edge 2*a* of the hitting face 2 and forming the upper surface of the head 1, a sole portion 5 which extends from the lower edge 2*b* of the hitting face 2 and forming the bottom surface of the head 1, a side portion 6 which extends between the crown portion 4 and the sole portion 5 from a toe side edge 2*c* of the face 2 to a heel side edge 2*d* of the face 2 through a back face BF of the head 1, and a hosel portion 7 which is disposed on a heel side of the crown portion 5 and has a shaft inserting hole 7*a* to attach a shaft (not shown). Since the axial center line CL of the shaft inserting hole 7*a* substantially agrees with the axial center line SL of the shaft, it is used as a basis to determine the lie angle.

Figure 4:
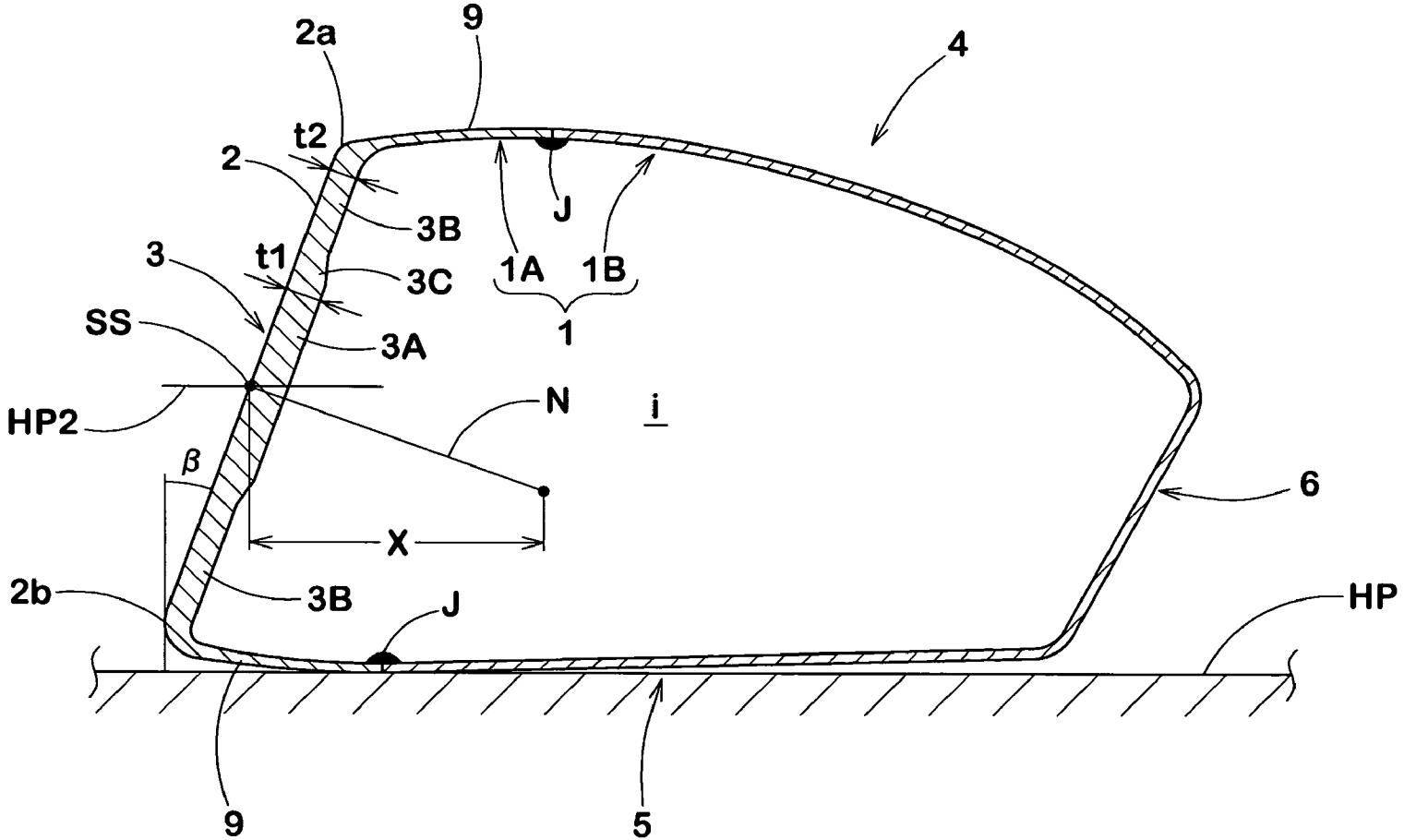
FIG. 4 is a cross sectional view along the line A-A of FIG. 3.

As shown in FIG. 4, the club head 1 is formed into a hollow structure having a hollow interior "i". The club head 1 of the present invention has a head volume of 420 to 500 $cm^3$. The "head volume" denotes a volume of the whole surrounded by the outer surface of head 1 the shaft inserting hole 7*a* of which is covered. By limiting the head volume within such a range, there can be increased not only the moment of inertia about the vertical axis passing through the center of gravity G of the head 1, but also the moment of inertia about a horizontal axis extending through the center of gravity G in the toe-heel direction. Therefore, unevenness in directionality and launch angles of hit balls can be decreased. It is preferable that the head volume is at least 440 $cm^3$. If the head volume is more than 500 $cm^3$, the durability of the head 1 tends to be deteriorated. Therefore, the head volume is preferably at most 460 $cm^3$. The club head 1 in this embodiment shown in the drawings is completely hollow, but the club heads according to the present invention may be provided with a filling material made of a foamed resin or the like in a part of the hollow portion "i".

The weight of the club head 1 is not particularly limited. If the weight is too large, a swing delay is easy to occur, and if the weight is too small, the swing tends to be not stabilized. From such points of view, the weight of the club head 1 is preferably at least 170 g, more preferably at least 175 g, the most preferably at least 180 g, and is also preferably at most 220 g, more preferably at most 210 g, further more preferably at most 200 g, the most preferably at most 190 g.

The club head 1 in this embodiment comprises, as shown in FIG. 4, a face member 1A made of a metallic material and including a main part of the face portion 3 (in this embodiment, the whole of the face portion 3), and a head body 1B made of a metallic material at the front of which the face member 1A is disposed and fixed to, for example, by welding.

The face member 1A may be in the form of a plate or may be in a cup-like form or the like. In this embodiment shown in the drawings, the face member 1A is formed into approximately a cup shape comprising a base portion which constitutes substantially the whole region of the face portion 3, and an extension 9 which extends toward the rear of the head from the peripheral edges 2*a*, 2*b*, 2*c* and 2*d* of the hitting face 2. The base portion of the face member 1A shown in this embodiment forms substantially the whole region of the face portion 3, but may be one constituting a part of the face portion 3. The base portion and the extension 9 are not joined by welding or the like means, but are formed into an integrated body by pressing, casting, forging or the like. Such a face member 1A enables to perform the welding with the head body 1B on a smooth surface like the surface of crown portion 4, sole portion 5 and/or side portion 6, whereby the welding workability can be improved. Further, since a welding joint J between the face member 1A and the head body 1B is located behind the edge of the hitting face 2, the cup-like face member 1A is preferable also from the viewpoint of preventing deterioration in the repellency of the face portion 3.

On the other hand, the head body 1B is formed to include the hosel portion 7 and constitutes a portion behind the welding joint J, namely main portions of the crown portion 4, sole portion 5 and side portion 6. The head body 1B can be produced in a known manner. For example, crown portion 4, sole portion 5, side portion 6 and hosel portion 7 are integrally formed into the head body 1B by casting.

In the present invention, the face portion 3 (in the case of the embodiment shown in the drawings, the face member 1A including face portion 3 and extension 9) is produced from a metallic material having a specific gravity of 4.30 to 4.60. As stated above, it is effective in suppressing the gear effect to make the depth of the center of gravity. From such a point of view, it is known to produce a face portion from a metallic material having a high specific gravity. However, if the specific gravity of the face portion is increased, there arise problems that the moment of inertia about the vertical axis of the club head, which has the highest contribution rate to improvement in direction performance of the club head, decreases and, further, since the position of the center of gravity becomes high, there is a possibility that the flight distance is decreased. For these reasons, in the present invention, the specific gravity of the face portion 3 is defined to 4.60 or less, preferably 4.55 or less, more preferably 4.40 or less, the most preferably 4.38 or less, whereby weight reduction of the face portion is achieved to produce a large weight margin, and the produced weight margin can be applied to suitable portions of the club head in the form of a weight member. Thus, the head volume can be increased with suppressing increase in head weight and, moreover, the moment of inertia about the vertical axis and the depth of the center of gravity can be optimized. On the other hand, if the specific gravity of the face portion 3 is too small, a problem of decrease in strength may arise. Therefore, the specific gravity is set to 4.30 or more.

Examples of the metallic material having a specific gravity of 4.30 to 4.60 are, for instance, titanium alloys such as Ti-6Al-4V (specific gravity 4.42), Ti-3Al-2.5V (specific gravity 4.48), Ti-4.5Al-2Mo-1.6V-0.5Fe-0.3Si-0.03C (trade mark "Ti-9" made by Kobe Steel, Ltd., specific gravity 4.51), Ti-4.5Al-4Cr-0.5Fe-0.2C (trade mark "KS ELF" made by Kobe Steel, Ltd., specific gravity 4.49), Ti-4.5Al-2Cr-1Mo-1.3V-0.5Fe-0.15C (trade mark "KS ELF-II" made by Kobe Steel, Ltd., specific gravity 4.51), Ti-8Al-1Mo-1V-0.15C (trade mark "Ti-811-C" made by Kobe Steel, Ltd., specific gravity 4.37), Ti-4.5Al-3V-2Fe-2Mo (trade mark "SP700" made by JFE Steel Corporation, specific gravity 4.54), Ti-5Al-1Fe (trade mark "Super TIX51AF" made by Nippon Steel Corporation, specific gravity 4.38), Ti-1Fe-0.35O (trade mark "Super TIX800" made by Nippon Steel Corporation, specific gravity 4.54), Ti-5Al-2Fe-3Mo (trade mark "Super TIX523AFM" made by Nippon Steel Corporation, specific gravity 4.45), Ti-6Al-1Fe (trade mark "VLTi" made by Daido Steel Co., Ltd., specific gravity 4.42), and the like.

Particularly preferred are Ti—Al—Fe alloys containing 4.5 to 5.5% by weight of aluminum, 0.5 to 1.5% by weight of iron, and the remaining amount of titanium and unavoidable impurities, e.g., Ti-5Al-1Fe alloy. These alloys have a high Young's modulus and a high tensile strength and can be processed, for example, by performing hot forging under suitable conditions. If the aluminum content is less than 4.5% by weight, fragile ω phase is easy to appear, so the tensile strength tends to be lowered. If the aluminum content is more than 5.5% by weight, the plastic deformation characteristic tends to lower to deteriorate the processability. Fe makes formation of intermetallic compounds with Ti difficult to thereby stabilize the β phase and to lower the deformation stress and, therefore, it serves to raise the plastic deformation characteristic so as to improve the processability. Therefore, if the Fe content is less than 0.5% by weight, such an effect cannot be sufficiently obtained. On the other hand, Fe is easy to cause hardening and going fragile if the alloy is kept at about 500° C. for a long time, so handling becomes difficult upon manufacturing. For such a reason, it is preferable that the upper limit of the Fe content is 1.5% by weight. The Ti—Al—Fe alloys may contain O, N, C, H, mixtures thereof or the like as the unavoidable impurities mentioned above.

It is particularly preferred that the Ti—Al—Fe alloys are those having a Young's modulus of 120 to 150 GPa and a tensile strength of 950 to 2,200 MPa. The titanium alloys having such high Young's modulus and tensile strength are advantageous in that a larger weight margin can be secured from the face portion 3 without impairing the durability, since the face portion can be formed thin with maintaining the strength thereof. From the viewpoint of enhancing the durability and the repellency in good balance, the Young's modulus is preferably at least 125 GPa, more preferably at least 130 GPa, and is preferably at most 145 GPa, more preferably at most 140 GPa, the most preferably at most 135 GPa.

Further, if the tensile strength of the Ti—Al—Fe alloys is less than 950 MPa, the face portion 3 must be made considerably thick in order to secure the durability and strength durable against repeated ball hitting. In that case, the repellency of the club head tends to be remarkably lowered or a sufficient weight margin tends to be not obtained because of increase in weight of the face portion 3. From such points of view, it is preferable that the tensile strength of these titanium alloys is at least 1,000 MPa, especially at least 1,100 MPa, more especially at least 1,200 MPa. On the other hand, if the tensile strength of the titanium alloys is more than 2,200 MPa, the toughness is lowered, so the head becomes fragile to lower the durability. From such a point of view, it is preferable that the tensile strength of the Ti—Al—Fe alloys is at most 1,800 MPa, especially at most 1,600 MPa.

In the present invention, the face portion 3 of the club head 1 is formed to have a thickness of 1.5 to 4.0 mm in order to secure the flight distance performance and durability which are required for wood-type golf club heads. That is to say, if the thickness is less than 1.5 mm, the durability tends to be deteriorated due to lack of strength of the face portion 3. If the thickness is more than 4.0 mm, the flight distance tends to be remarkably decreased since the face portion 3 does not sufficiently bend on hitting to deteriorate the repellency.

The thickness of the face portion 3 may be constant over the entire region, but is preferably varied so that, as shown in FIGS. 2 and 4, the face portion 3 includes a central thick portion 3A having relatively a larger thickness t1 (maximum thickness in this embodiment shown in the drawings) and a thin peripheral portion 3B which annularly extends around the central thick portion 3A to surround it and which has a thickness t2 smaller than the thickness t1 of the central portion 3A (thickness t2 being the minimum thickness in this embodiment).

The central thick portion 3A forms a central region including at least a sweet spot SS (i.e., a preferable hitting zone). The sweet spot SS denotes, as shown in FIG. 4, a point at which a normal line N drawn from the center of gravity G with respect to the face 2 intersects the face 2. Such a face portion 3 enables to raise the coefficient of restitution of the head 1 to the maximum within the range specified by golf rules, since the peripheral thin portion 3B is easily bent at hitting golf balls while the strength and durability of the central thick portion 3A which frequently contacts the balls are maintained on sufficiently high levels. The peripheral thin portion 3B also serves to decrease the weight of the face portion 3 to thereby decrease the depth of the center of gravity.

The thickness t1 of the central thick portion 3A is not particularly limited, but from the viewpoints as mentioned above, it is preferable that the central thick portion 3A has a thickness t1 of at least 2.5 mm, especially at least 2.8 mm, and has a thickness t1 of at most 3.5 mm. The thickness t2 of the peripheral thin portion 3B is also not particularly limited, but it is preferable that the peripheral thin portion 3B has a thickness t2 of at least 1.5 mm, especially at least 2.0 mm, and has a thickness t2 of at most 3.0 mm.

In the present invention, a thickness-transitional portion 3C at which the thickness smoothly changes and which connects the both portions 3A and 3B may be disposed between the central thick portion 3A and the peripheral thin portion 3B, as shown in FIG. 4. The portion 3C serves to ease stress concentration at the boundary between the portions 3A and 3B to thereby further improve the durability of the face portion 3.

In order to more surely enhance the repellency and the durability of the club head, it is preferable that the average thickness "ta" of the face portion 3 is from 2.0 to 3.0 mm. The "average thickness of the face portion 3" as shown herein means an area-weighted average value calculated under consideration of thickness of respective portions 3A, 3B and the like of the face portion 3 by the following equation:

$$\text{Average thickness } ta=\Sigma(tai\cdot Si)/\Sigma Si(i=1,2\ldots)$$

wherein "tai" is a thickness of an optional region "i" of the face portion 3, and Si is an area of the region "i" occupied by the thickness "tai".

In the club head 1 of the present invention, the X/Y ratio of the depth X (mm) of the center of gravity to the moment of inertia Y ($g\cdot cm^2$) about the vertical axis passing through the center of gravity is set to a small value, specifically 0.0070 or less. The "depth of the center of gravity" denotes a horizontal length between the center of gravity G and the sweet spot SS on the hitting face 2 in the front-rear direction of the club head 1.

When the X/Y ratio is large, no matter how large the moment of inertia Y is made, the depth of the center of gravity also relatively becomes large, so a moment rotating the head on an off-center hit is increased and accordingly a large gear effect tends to appear. On the other hand, when the X/Y ratio is set to not more than 0.0070, preferably not more than 0.0065, more preferably not more than 0.0060, it is possible to restrict the depth X of the center of gravity to such a small value as exerting no bad influence on the moment of inertia Y about the vertical axis. As a result, the gear effect on off-center hits is surely suppressed and the amount of side spin of hit ball is decreased to stabilize the flight direction performance. This parameter has been found for the first time by the present inventor and noticeable effects thereof will be shown in the working examples described after.

The under limit of the X/Y ratio is not particularly limited because the smaller the depth X of the center of gravity, the flight direction performance on off-center hits is more improved. However, in view of the volume of club head 1 and a conventional head shape, it would be difficult to decrease the X/Y ratio to less than 0.0050 and, therefore, it is practical to set the X/Y ratio to 0.0050 or more.

The moment of inertia Y of the club head 1 about the vertical axis is not particularly limited, but from the viewpoints of improving the flight direction performance and making the X/Y value small, it is preferable that the head 1 has a moment of inertia Y of 3,500 $g\cdot cm^2$ or more, especially 3,800 $g\cdot cm^2$ or more, more especially 4,000 $g\cdot cm^2$ or more. The upper limit thereof is also not particularly limited, but in view of other restrictions such as golf rules, head weight, swing easiness and the like, it is preferable that the moment of inertia Y is at most 5,900 $g\cdot cm^2$.

Similarly, in the present invention, the depth X of the center of gravity of the club head 1 is not particularly limited. However, from the viewpoints of improving the flight direction performance and making the X/Y value small, it is preferable that the head 1 has a depth of the center of gravity of 30 mm or less, especially 28 mm or less, more especially 26 mm or less. On the other hand, if the depth of the center of gravity is too small, there is a possibility that the production of club heads will be difficult in view of the head volume of a conventional head shape. Therefore, it is preferable that the depth X of the center of gravity is at least 18 mm, especially at least 20 mm, more especially at least 22 mm.

The club head 1 of the present invention has a fitting face convexly curved such that, as shown in FIGS. 1 to 3, an intersection line K of the fitting face 2 and a horizontal plane HP2 including the sweet spot SS is smoothly convex toward the front of the head 1 when the face is viewed from above. In other words, the club head 1 is provided with a horizontal face bulge. In case of conventional wood-type club heads, the radius of curvature of the convex intersection line K is generally from 254 to 304 mm (10 to 12 inches).

Figure 10A:
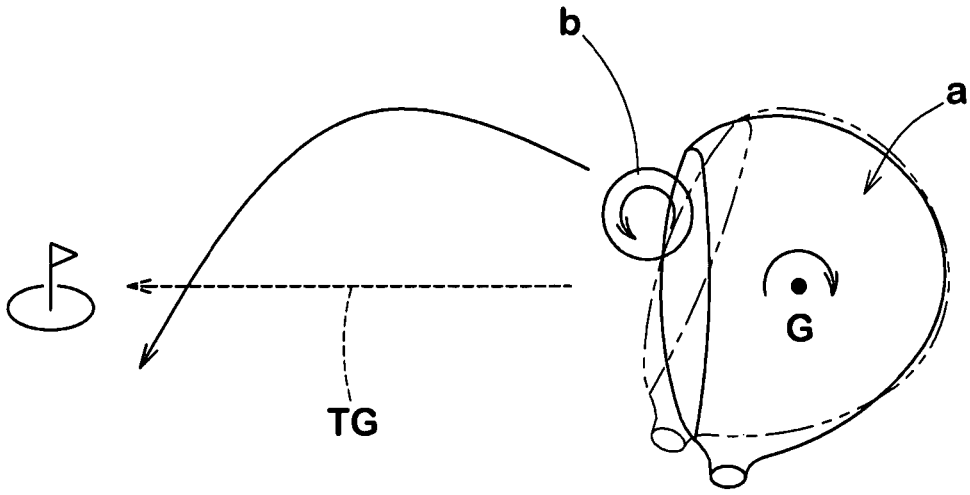
FIGS. 10(A) and 10(B) are schematic views for illustrating the gear effect.
Figure 10B:
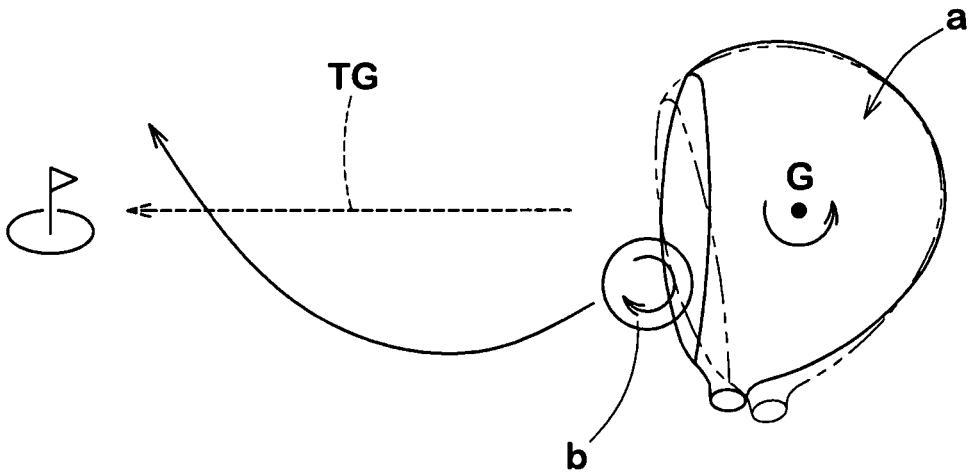

When a wood-type golf club is set in the standard state, the hitting face provided with bulge looks toward the right of the target line of flight on the toe side of the sweet spot SS and looks toward the left of the target line on the heel side of the sweet spot SS. Such a convex curvature is provided in order to compensate for excessive gear effect which is produced by off-center hit and causes a ball to greatly curve. That is to say, when a wood-type club strikes a golf ball at a point which is offset from the center of the face, a spin is imparted to the ball by the gear effect. As shown in FIG. 10(A), clockwise rotation of a club head "a" on a toe hit opens the face and causes a ball "b" to fly initially to the right of the target line TG of flight. On the other hand, the toe hit provides a hook spin to the ball "b" by the gear effect, and the hook spin causes the ball to curve back toward the target line TG. Usually the gear effect spin is excessive and the ball would hook to the left of the target line TG. For this reason, it is known to provide the hitting face of a wood-type club head with bulge in order to compensate for excessive gear effect spin on tow and heel hits so that a ball hit on either the toe or the heel lands approximately along the target line of flight.

In the present invention, the club head is designed to have a small X/Y ratio of the depth X of the center of gravity to the moment of inertia Y in order to suppress the gear effect on off-center hit so as to decrease the amount of side spin of a ball. Therefore, the degree of curving in flight of hit ball is smaller than that of a ball hit by conventional club heads. Thus, the hitting face 2 of the club head 1 of the present invention is provided with a horizontal bulge having a large radius of curvature as compared with conventional club heads, i.e., a radius of curvature Rc of 330.2 to 457.2 mm (13 to 18 inches) for the intersection line K. This is one of the features of the present invention. That is to say, in the present invention, the angle of driving a ball toward the right or left of the target line of flight on off-center hit is made small while suppressing the curving in flight of a ball on off-center hit, whereby the flight direction performance is remarkably improved as compared with conventional club heads. In particular, the radius of curvature Rc of the intersection line K is preferably at least 342.9 mm (13.5 inches), more preferably at least 355.6 mm (14 inches), and is preferably at most 431.8 mm (17 inches), more preferably at most 406.4 mm (16 inches).

Figure 5:
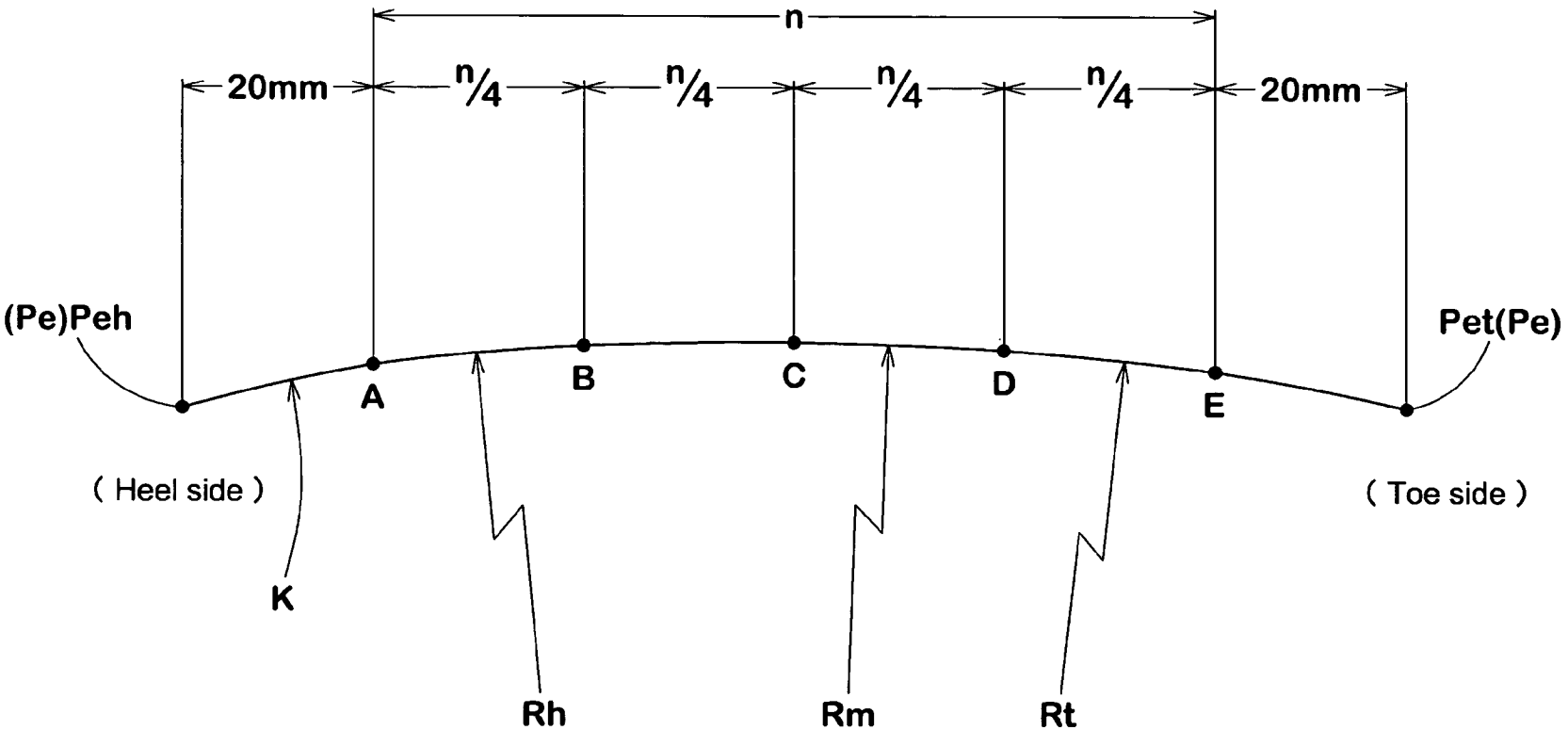
FIG. 5 is a diagram showing an intersection line between the face of the club head and the horizontal plane.

The "radius of curvature Rc" of the intersection line K as defined herein is determined as follows: As shown in FIG. 5, firstly, the intersection line K is obtained. Then, there are obtained an effective heel side end point A on the line K which is apart from the heel side outermost end Peh on the line K toward the sweet spot SS by a distance of 20 mm in the toe-heel direction, and an effective toe side end point E on the line K which is apart from the toe side outermost end Pet on the line K toward the sweet spot SS by a distance of 20 mm in the toe-heel direction. Since a region between the outermost end Peh and the point A and a region between the outermost end Pet and the point E can be regarded as a region substantially not participating in hitting of balls, these regions are excluded on determining the radius of curvature Rc. Then, three points which divide the length "n" in the toe-heel direction between the effective heel side and toe side end points A and E into four equal parts, i.e., a heel side point B, a middle point C and a toe side point D, are obtained. The radius of a single hypothetical arc passing through the effective heel side end point A, the heel side point B and the middle point C is defined as a radius of curvature Rh on the heel side of the intersection line K. Similarly, the radius of a single hypothetical arc passing through the heel side point B, the middle point C and the toe side point D is defined as a radius of curvature Rm of a middle portion of the intersection line K. Further, the radius of a single hypothetical arc passing through the middle point C, the toe side point D and the effective toe side end point E is defined as a radius of curvature Rt on the toe side of the intersection line K. The average value of the heel side radius of curvature Rh, the radius of curvature Rm of the middle portion and the toe side radius of curvature Rt is defined as the radius of curvature Rc of the intersection line K.

The term "radius of curvature" generally means a radius of curvature at a point on a curved line, but the radii Rc, Rh, Rm and Rt of curvature as used herein follow the above definition.

Figure 6A:
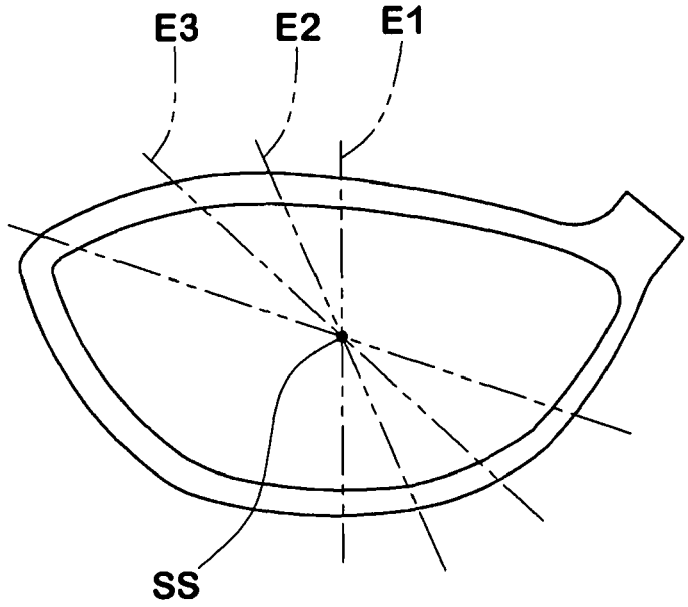
FIG. 6(A) is a front view illustrating a peripheral edge of the face.
Figure 6B:
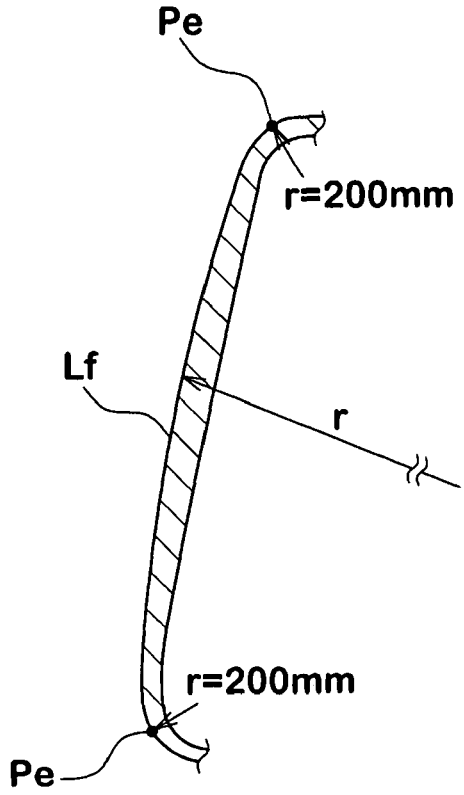
FIG. 6(B) is a cross sectional view along the line E1 of FIG. 6(A)

The heel side outermost end Peh and the toe side outermost end Pet of the line K are points on the periphery of the hitting face 2. In the case that the periphery of the face 2 is defined by a clear ridge line in the face portion 3, this ridge line denotes the periphery of the face 2. However, in the case that the ridge line is not clear, the club head 1 is cut by a large number of planes E1, E2, E3 . . . passing through the above-mentioned normal line N, as shown in FIG. 6(A). In each section, positions Pe at which the radius of curvature "r" of an outer contour line Lf of the face 2, namely the vertical roll radius "r" of the exterior surface of the face 2, reaches 200 mm first when measured from the sweet spot side, are defined as the periphery of the face 2. In the case that the face has face lines or punch mark, they are filled for determination of the outer contour line Lf.

The intersection line K may comprise a single arc (i.e., Rc=Rh=Rm=Rt) or a plurality of arcs which are smoothly continuous with each other. In the latter case, it is preferable that the heel side radius Rh, middle portion radius Rm and toe side radius Rt of the line K all fall within the range of 330.2 to 457.2 mm. Further, it is particularly effective that at all of the effective heel side end point A, the heel side point B, the middle point C, the toe side point D and the effective toe side end point E, a single hypothetical arc passing through three points, namely each of these points A to E and points on the both sides thereof 5 mm away from it, also has a radius of curvature within the range of 330.2 to 457.2 mm.

A golf club shaft (now shown) is attached to a heel side of the club head 1 through the hosel portion 7. Therefore, when a ball is hit on the heel of the club head, the rotation amount of the head rotating about the center of gravity G is smaller as compared with the toe hit and, therefore, the gear effect is hard to occur. That is to say, the curve of the flight line on heel hit is smaller than that on toe hit. Therefore, it is preferable that in the intersection line K, the radius of curvature Rh on the heel side is larger than the radius of curvature Rm of the middle portion of the line K and the radius of curvature Rt on the toe side. Specifically, it is preferable that the heel side radius Rh is larger than the middle portion radius Rm and the toe side radius Rt by at least 12.7 mm (0.5 inch), especially at least 25.4 mm (1 inch). On the other hand, if the difference in radius of curvature is excessive, the appearance of the face 2 becomes distorted and the face is squared with difficulty or the ball will not curve back toward the target line of flight. Therefore, the difference of the radius Rh from the radii Rm and Rt is preferably at most 101.6 mm (4 inches), more preferably at most 76.2 mm (3 inches), the most preferably at most 50.8 mm (2 inches).

Figure 7:
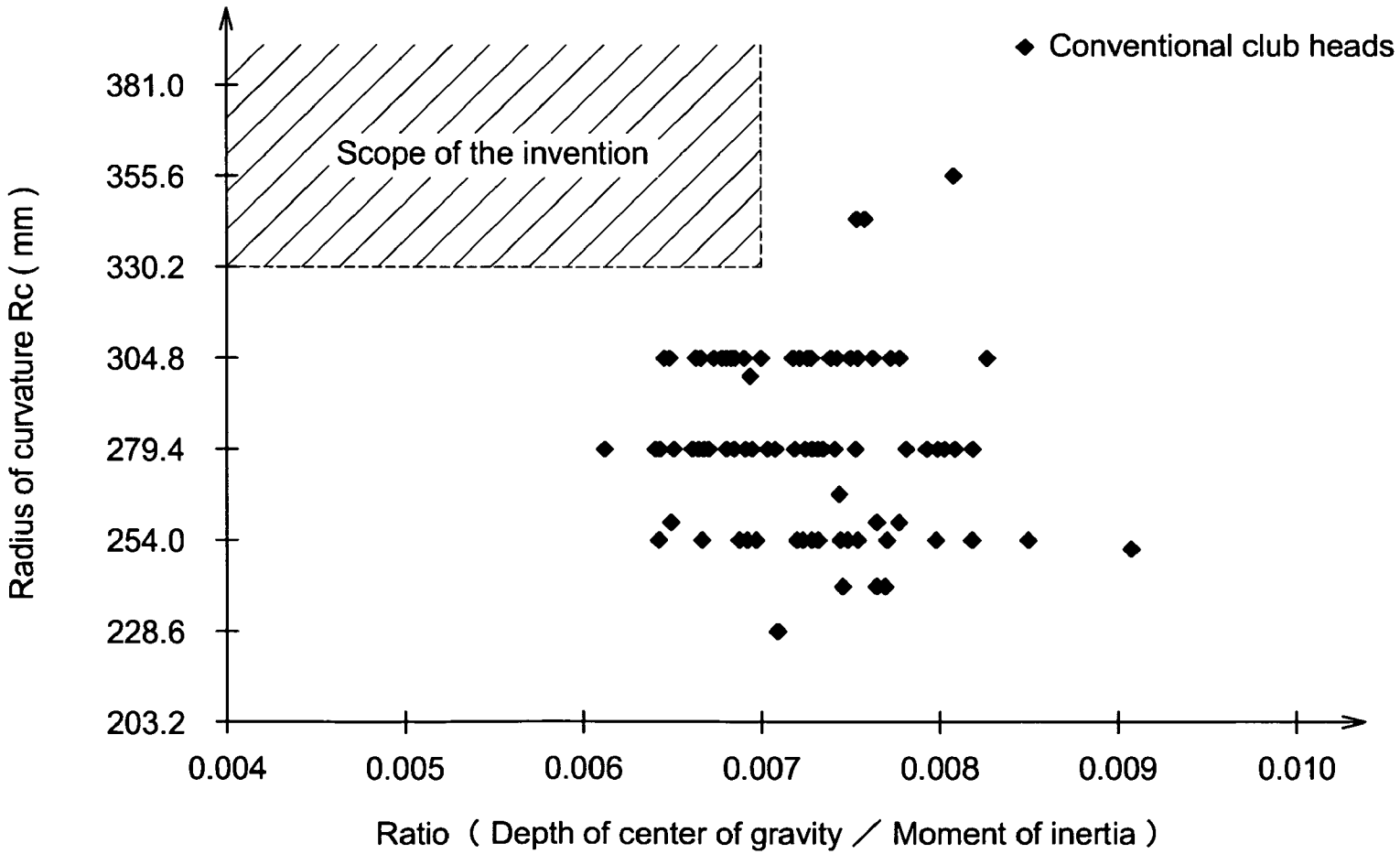
FIG. 7 is a graph showing a relationship between a radius of curvature of the above-mentioned intersection line and a ratio of the depth of the center of gravity to the moment of inertia of a club head.

FIG. 7 is a graph showing a relationship between the radius of curvature Rc of the intersection line K and the X/Y ratio of the depth X of the center of gravity G to the moment of inertia Y about the vertical axis of a club head with respect to known golf club heads having a head volume of at least 400 $cm^3$. Some known club heads have a horizontal bulge radius (radius of curvature Rc of the intersection line K) of 330.2 mm (13 inches) or more, but the X/Y ratio of these known club heads is more than 0.0070. Such club heads exhibit a large gear effect on off-center hits and cause a ball to greatly curve, but the bulge cannot compensate for the excessive gear effect spin because the radius of curvature Rc of these known club heads is large. Therefore, these known club heads are not satisfactory in flight direction performance.

In the present invention, a means for achieving the desired X/Y ratio is not particularly limited. In a preferable embodiment, for example, each portion of the club head 1 is formed as thin as possible, and a surplus weight obtained thereby is disposed in a peripheral portion of the head in the form of a weight member made of a material having a large specific gravity. In particular, in order to have a low center of gravity of a head so as to achieve a large launch angle and a low back spin, it is preferable to dispose the weight member at a location which is in a lower region of sole portion 5 or side portion 6 and which is apart from the center of gravity location obtained before attaching the weight.

In the embodiment shown in FIG. 3, the club head 1 is provided with a toe side weight member Wt disposed on the toe side of the sole portion 5 and a heel side weight member Wh disposed on the heel side of the sole portion 5. As a material of the weight members Wt and Wh are preferred a metallic material having a larger specific gravity than the face member 1A and the head body 1B, especially a metallic material such as tungsten, nickel, stainless steel or alloys of two or more kinds of these metals. It is preferable that the material of the weight member has a specific gravity of at least 7.0, especially at least 10.0, more especially at least 13.0.

Further, it is preferable that at least two weight members are disposed, and it is more preferable that these weight members are disposed so that the center of gravity of each weight member is located on a front side of the center of gravity G of the head 1, at least one weight member is located on the toe side of the center of gravity G and at least one weight member is located on the heel side of the center of gravity G. By such an arrangement of the weight members, the X/Y ratio of the depth X of the center of gravity to the moment of inertia Y can be controlled within the desired range while achieving a large volume of the head with suppressing increase in head weight. Thus, the flight direction performance is more surely improved.

In the present invention, in order to suppress the gear effect, the depth X of the center of gravity is set to a small value as compared with the moment of inertia. In general, in case of a golf club head having a small depth of the center of gravity, the face is hard to return to the address position during the swing, although it depends on a golfer's ability and, therefore, the face tends to strike a ball in the open state and cause the ball to fly to the right of the target line. Also, a slice spin is easy to be imparted to the ball, the ball driven out toward the right tends to further curve toward the right. Such a club head is generally expressed to be bad in ball catch.

Preferably, in order to prevent deterioration of ball catch, the club head 1 of the present invention has a small face progression FP. As shown in FIG. 3, the "face progression FP denotes a horizontal length in the front-rear direction in the standard state of the head from the vertical plane VP to the farthest leading edge Le of the face 2. In the present invention, the face progression is preferably 22 mm or less, more preferably 20 mm or less, the most preferably 18 mm or less. Small face progression serves to cause the face to return back to the address position during swing, but it is preferable that the face progression FP is at least 10 mm, especially at least 12 mm, more especially at least 14 mm.

In the present invention, it is preferable to prepare both the face member 1A and the head body 1B from a titanium alloy. In particular, it is preferable to prepare the head body 1B from a titanium alloy (hereinafter referred to as "second titanium alloy") having a larger specific gravity than that of the titanium alloy (hereinafter referred to as "first titanium alloy") used in the face member 1A. This is useful for increasing the moment of inertia Y about the vertical axis of the head 1. If the specific gravity of the second titanium alloy is too large, the head weight is easy to markedly increase and, therefore, it is preferably at most 4.51. The second titanium alloy can be selected from the titanium alloys exemplified for the face member 1A.

Since the first titanium alloy has a smaller specific gravity than the second titanium alloy, the sg1/sg2 ratio of the specific gravity sg1 of the first alloy to the specific gravity sg2 of the second alloy is less than 1.0, but the sg1/sg2 ratio is preferably about 0.95 or more. In a preferable embodiment as shown in the accompanying drawings, for example, a Ti-6Al-4V alloy is used as a second titanium alloy while preparing the face member 1A from a Ti-5Al-1Fe alloy having a specific gravity of 4.38. In that case, since the specific gravity of the second titanium alloy is about 4.42, the difference in specific gravity from the first titanium alloy is about 0.04 and the sg1/sg2 ratio is 0.99.

It is preferable that the second titanium alloy also has sufficient strength and Young's modulus for use in head 1 as well as the first titanium alloy. Specifically, the Young's modulus of the second titanium alloy is preferably at least 100 GPa, more preferably at least 105 GPa, and is preferably at most 120 GPa, more preferably at most 115 GPa. The tensile strength of the second titanium alloys is preferably at least 900 MPa, more preferably at least 1,000 MPa, and is preferably at most 1,200 MPa.

In particular, it is preferable that the e1/e2 ratio of the Young's modulus e1 of the first titanium alloy to the Young's modulus e2 of the second titanium alloy is at least 1.0, especially at least 1.05, more especially at least 1.10, and as for the upper limit, is at most 1.50, especially at most 1.35, more especially at most 1.30. It is also preferable that the S1/S2 ratio of the tensile strength S1 of the first titanium alloy to the tensile strength S2 of the second titanium alloy is at least 1.05, and as for the upper limit, is at most 1.35, especially at most 1.30. When the Young's modulus and tensile strength of the second titanium alloy used in the head body 1B are specified in such a manner in relation to those of the first titanium alloy used in the face member 1A, stress concentration at a joint portion of joining the face member and the head body is eased to improve the durability of the head 1.

While a preferable embodiment of the present invention has been described with reference to the drawings, it goes without saying that the present invention is not limited to only such an embodiment and various changes and modifications may be made.

The present invention is more specifically described and explained by means of the following Examples and Comparative Examples. It is to be understood that the present invention is not limited to these Examples.

EXAMPLES 1 TO 4 AND COMPARATIVE EXAMPLES 1 TO 4

Wood-type golf club heads having a two piece structure as shown in FIGS. 1 to 4 were prepared according to the specifications shown in Table 1 and a hitting test thereof was made. The specifications common to the respective heads are as follows:

Head volume: 460 $cm^3$
Head weight: 198 g
Loft angle: 10.5°

Face Member:

In Example 5 was used a product of hot forging at 940° C. for 10 minutes of a Ti-5Al-1Fe alloy (Al: 5% by weight, Fe: 1% by weight, Ti and unavoidable impurities: the rest; specific gravity 4.38; tensile strength 1,300 MPa; Young's modulus 135 GPa).

In the other Examples and Comparative Examples was used a press molding product of a rolled plate of a Ti-6Al-4V alloy (Al: 6% by weight, V: 4% by weight, Ti and unavoidable impurities: the rest; specific gravity 4.42; tensile strength 1,200 MPa; Young's modulus 115 GPa).

Each face member was formed to have a center thick portion including a sweet spot and a peripheral thin portion around the center portion. The center portion had a thickness of 3.3 mm, and the peripheral portion had a thickness of 2.5 mm.

Head Body:

In all Examples and Comparative Examples was used a lost-wax precision casting product of the Ti-6Al-4V alloy mentioned above. The thickness of the crown and side portions was 0.7 mm, and the thickness of the sole portion was 0.9 mm.

Figure 8A:
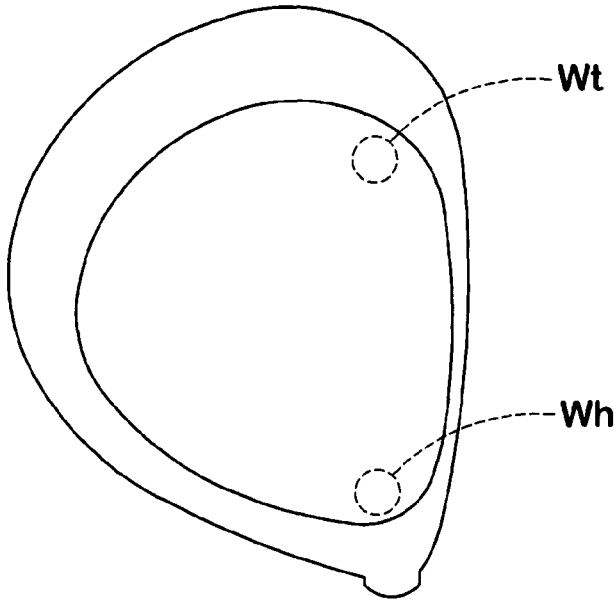
FIGS. 8(A) and 8(B) are bottom views of the club head illustrating the position of a weight member disposed in Examples described after.
Figure 8B:
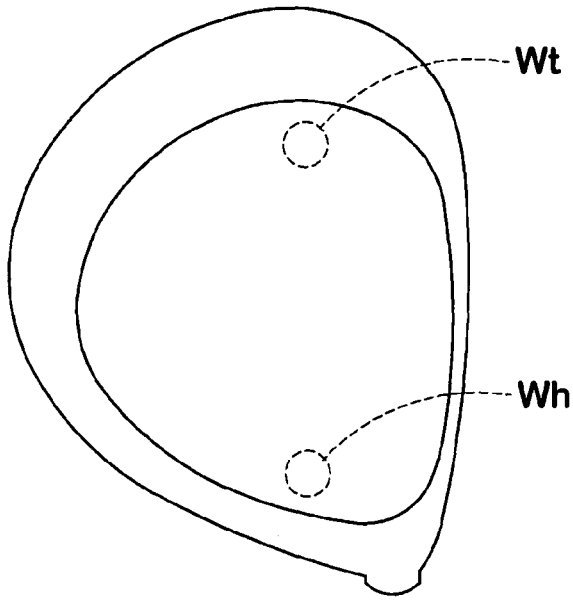
Figure 9:
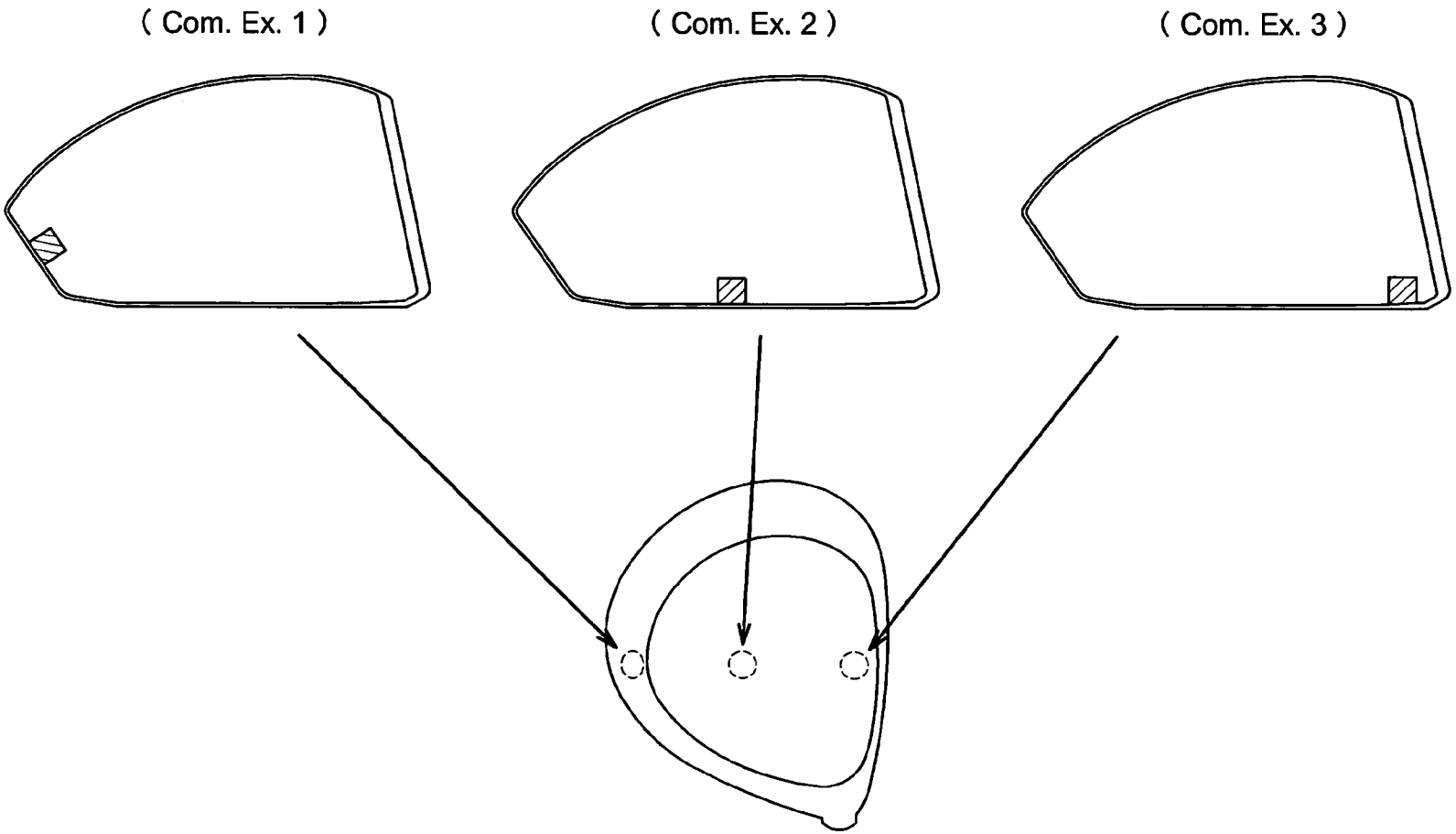
FIG. 9 is a view illustrating the position of a weight member disposed in Comparative Examples described after.

Weight members having a columnar shape were prepared by sintering of a W—Ni alloy having a specific gravity of 14.5, and were attached to the locations shown in FIGS. 8A, 8B and 9 with an adhesive (DP-460 made by Sumitomo 3M Limited).

The face member and the head body were joined by plasma welding.

The hitting test was made as follows:

The same FRP shafts were attached to all heads to be tested to give wood gold clubs having a full length of 46 inches. Each of the golf clubs was attached to a swing robot, and struck three-piece golf balls (trade mark "SRIXON" Z-UR made by SRI Sports Limited) at a head speed of 45 m/s measured at the sweet spot. There were measured the amount of side spin (minus sign: hook spin, plus sign: slice spin), the angle of hitting direction to the right or left (minus sign: flying to the left direction, plus sign: flying to the right direction), and the amount of swerve from the target direction to the stopping position of a hit ball (minus sign: swerve to the left, plus sign: swerve to the right). In each test, six golf balls were hit for each of a toe hit of hitting a ball at a position apart from the sweet spot toward the toe by 20 mm and a heel hit of hitting a ball at a position apart from the sweet spot toward the heel by 20 mm.

The results are shown in Table 1 by the average of found values obtained by hitting 6 balls for each club.

TABLE 1

| | Com. Ex. 1 | Com. Ex. 2 | Com. Ex. 3 | Com. Ex. 4 | Ex. 1 | Ex. 2 | Ex. 3 |
|---|---|---|---|---|---|---|---|
| Depth of the center of gravity X (mm) | 35 | 30 | 24 | 25 | 25 | 25 | 25 |
| Moment of inertia Y (g · cm$^2$) | 4200 | 4000 | 3400 | 4100 | 4100 | 4100 | 4100 |
| X/Y ratio | 0.0083 | 0.0075 | 0.0071 | 0.0061 | 0.0061 | 0.0061 | 0.0061 |
| Face progression (mm) | 18 | 18 | 18 | 18 | 18 | 18 | 22 |
| Radius of curvature of face (mm) | | | | | | | |
| Toe side radius | 279.4 | 279.4 | 279.4 | 279.4 | 330.2 | 330.2 | 330.2 |
| Middle radius | 279.4 | 279.4 | 279.4 | 279.4 | 330.2 | 330.2 | 330.2 |
| Heel side radius | 279.4 | 279.4 | 279.4 | 279.4 | 330.2 | 381.0 | 381.0 |
| Average radius | 279.4 | 279.4 | 279.4 | 279.4 | 330.2 | 347.1 | 347.1 |
| Amount of side spin (r.p.m.) | | | | | | | |
| Toe hit | −560 | −510 | −480 | −420 | −360 | −360 | −300 |
| Heel hit | +530 | +490 | +440 | +400 | +330 | +280 | +360 |
| Hitting direction angle (degree) | | | | | | | |
| Toe hit | +5.0 | +4.4 | +4.1 | +3.8 | +3.4 | +3.4 | +4.1 |
| Heel hit | −6.3 | −5.7 | −4.8 | −3.9 | −3.1 | −2.8 | −2.6 |
| Amount of right- or left-ward swerve (m) | | | | | | | |
| Toe hit | +6.3 | +5.0 | +4.2 | +3.5 | +2.7 | +2.7 | +3.6 |
| Heel hit | −7.3 | −6.4 | −5.4 | −4.6 | −3.0 | −2.6 | −2.2 |

| | Ex. 4 | Ex. 5 | Com. Ex. 5 | Com. Ex. 6 | Com. Ex. 7 | Com. Ex. 8 |
|---|---|---|---|---|---|---|
| Depth of the center of gravity X (mm) | 23 | 27 | 25 | 25 | 25 | 25 |
| Moment of inertia Y (g · cm$^2$) | 4300 | 4000 | 4100 | 4100 | 4100 | 4100 |
| X/Y ratio | 0.0053 | 0.0068 | 0.0061 | 0.0061 | 0.0061 | 0.0061 |
| Face progression (mm) | 18 | 18 | 18 | 18 | 18 | 18 |
| Radius of curvature of face (mm) | | | | | | |
| Toe side radius | 381.0 | 330.2 | 304.8 | 317.5 | 469.9 | 482.6 |
| Middle radius | 381.0 | 330.2 | 304.8 | 317.5 | 469.9 | 482.6 |
| Heel side radius | 431.8 | 381.0 | 304.8 | 317.5 | 469.9 | 482.6 |
| Average radius | 397.9 | 347.1 | 304.8 | 317.5 | 469.9 | 482.6 |
| Amount of side spin (r.p.m.) | | | | | | |
| Toe hit | −260 | −430 | −400 | −380 | −530 | −600 |
| Heel hit | +220 | +370 | +370 | +350 | +500 | +540 |
| Hitting direction angle (degree) | | | | | | |
| Toe hit | +2.3 | +3.8 | +3.6 | +3.5 | +2.0 | +1.6 |
| Heel hit | −1.8 | −3.5 | −3.5 | −3.3 | −1.5 | −0.9 |
| Amount of right- or left-ward swerve (m) | | | | | | |
| Toe hit | +1.2 | +3.0 | +3.3 | +3.1 | −3.3 | −5.2 |
| Heel hit | +0.5 | −3.2 | −4.0 | −3.5 | +4.0 | +4.8 |

From the results shown in Table 1, it is confirmed that the golf club heads of the Examples according to the present invention have better flight direction performance than the club heads of the Comparative Examples such that the side spin amount is small and the angle of driving out a golf ball with respect to the target line is also small. In particular, since the club heads of Examples 2 and 3 have a large heel side bulge, the amount of rightward or leftward swerve on heel hits is suppressed small. Further, it is found that the amount of swerve of a hit ball in Example 3 shifts toward the right direction as compared with Example 2. The reason is considered that the face progression of the club head of Example 3 is larger than that of the club head of Example 2.

What is claimed is:

1. A hollow wood-type golf club head having a head volume of 420 to 500 cm$^3$, and comprising a face portion having a hitting face for hitting a golf ball on a front side and a sole portion extending from the lower edge of the hitting face and forming a bottom surface of the club head, wherein:

said face portion is made of a metallic material having a specific gravity of 4.30 to 4.60 and has a thickness of 1.5 to 4.0 mm, in a standard state that the club head is placed on a horizontal plane at prescribed lie and loft angles, an X/Y ratio is 0.0070 or less in which X is a depth (mm) of the center of gravity of the club head which is a horizontal length between the center of gravity and a sweet spot on said hitting face in a front-rear direction of the club head, and Y is a moment of inertia ($g \cdot cm^2$) of the club head about the vertical axis passing through the center of gravity, said hitting face is convexly curved such that an intersection line of said hitting face and a horizontal plane including the sweet spot is convex toward the front of the club head, and a radius of curvature Rc of said intersection line is from 330.2 to 457.2 mm, and a radius of curvature on a heel side portion of the intersection line is larger than each of radii of curvature of a middle portion and a toe side portion of the intersection line by at least 12.7 mm, said sole portion is provided with a toe side weight member Wt disposed on a toe side and a heel side weight member Wh disposed on a heel side, and the center of gravity of each of the weight members Wt and Wh is located on a front side of the center of gravity of the club head, and said club head comprising a head body and a face member which constitutes a main part of said face portion and is fixed to said head body, in which said face member is made of a first titanium alloy having a Young's modulus of 120 to 150 GPa and said head body is made of a second titanium alloy having a larger specific gravity than that of said first titanium alloy.

2. The golf club head of claim 1, wherein a face progression which is a horizontal length in the front-rear direction in the standard state of the club head from a vertical plane VP for determining said lie angle to a farthest leading edge of said hitting face, is from 10 to 22 mm.

3. The golf club head of claim 1, wherein the radius of curvature on a heel side of said intersection line is larger than the radius of curvature on a toe side of said intersection line.

4. The golf club head of claim 1, wherein said first titanium alloy has a tensile strength of 950 to 2,200 MPa.

5. The golf club head of claim 1, wherein said first titanium alloy comprises 4.5 to 5.5% by weight of aluminum, 0.5 to 1.5% by weight of iron, and the rest of titanium and unavoidable impurities.

6. The golf club head of claim 1, wherein each of the weight members Wt and Wh has a specific gravity of at least 7.0, and said second titanium alloy has a specific gravity of at most 4.51.

7. A hollow wood-type golf club head having a head volume of 420 to 500 $cm^3$, and comprising a face portion having a hitting face for hitting a golf ball on a front side and a sole portion extending from the lower edge of the hitting face and forming a bottom surface of the club head, wherein:

said face portion is made of a metallic material having a specific gravity of 4.30 to 4.60 and has a thickness of 1.5 to 4.0 mm, in a standard state that the club head is placed on a horizontal plane at prescribed lie and loft angles, an X/Y ratio is 0.0070 or less in which X is a depth (mm) of the center of gravity of the club head which is a horizontal length between the center of gravity and a sweet spot on said hitting face in a front-rear direction of the club head, and Y is a moment of inertia ($g \cdot cm^2$) of the club head about the vertical axis passing through the center of gravity, said hitting face is convexly curved such that an intersection line of said hitting face and a horizontal plane including the sweet spot is convex toward the front of the club head, a radius of curvature Rc of said intersection line is from 330.2 to 457.2 mm, and a radius of curvature on a heel side portion of said intersection line is larger than each of radii of curvature of a middle portion and a toe side portion of said intersection line by at least 12.7 mm, and said sole portion is provided with a toe side weight member Wt disposed on a toe side and a heel side weight member Wh disposed on a heel side, and the center of gravity of each of the weight members Wt and Wh is located on a front side of the center of gravity of the club head.

8. The golf club head of claim 7, wherein a face progression which is a horizontal length in the front-rear direction in the standard state of the club head from a vertical plane VP for determining said lie angle to a farthest leading edge of said hitting face, is from 10 to 22 mm.

9. The golf club head of claim 7, wherein the radius of curvature on a heel side of said intersection line is larger than the radius of curvature on a toe side of said intersection line.

10. The golf club head of claim 7, wherein said club head comprises a head body and a face member which constitutes a main part of said face portion and is fixed to said head body, in which said face member is made of a first titanium alloy having a Young's modulus of 120 to 150 GPa and said head body is made of a second titanium alloy having a larger specific gravity than that of said first titanium alloy.

11. The golf club head of claim 10, wherein said first titanium alloy has a tensile strength of 950 to 2,200 MPa.

12. The golf club head of claim 10, wherein said first titanium alloy comprises 4.5 to 5.5% by weight of aluminum, 0.5 to 1.5% by weight of iron, and the rest of titanium and unavoidable impurities.

13. The golf club head of claim 10, wherein each of the weight members Wt and Wh has a specific gravity of at least 7.0, and said second titanium alloy has a specific gravity of at most 4.51.

14. A hollow wood-type golf club head having a head volume of 420 to 500 $cm^3$, and comprising a face portion having a hitting face for hitting a golf ball on a front side and a sole portion extending from the lower edge of the hitting face and forming a bottom surface of the club head, wherein:

said face portion is made of a metallic material having a specific gravity of 4.30 to 4.60 and has a thickness of 1.5 to 4.0 mm, in a standard state that the club head is placed on a horizontal plane at prescribed lie and loft angles, an X/Y ratio is 0.0070 or less in which X is a depth (mm) of the center of gravity of the club head which is a horizontal length between the center of gravity and a sweet spot on said hitting face in a front-rear direction of the club head, and Y is a moment of inertia ($g \cdot cm^2$) of the club head about the vertical axis passing through the center of gravity, and said hitting face is convexly curved such that an intersection line of said hitting face and a horizontal plane including the sweet spot is convex toward the front of the club head, a radius of curvature Rc of said intersection line is from 330.2 to 457.2 mm, and a radius of curvature on a heel side portion of said intersection line is larger than each of radii of curvature of a middle portion and a toe side portion of said intersection line by at least 12.7 mm.

15. The golf club head of claim 14, wherein a face progression which is a horizontal length in the front-rear direction in the standard state of the club head from a vertical plane VP for determining said lie angle to a farthest leading edge of said hitting face, is from 10 to 22 mm.

16. The golf club head of claim 14, wherein the radius of curvature on a heel side of said intersection line is larger than the radius of curvature on a toe side of said intersection line.

17. The golf club head of claim 14, wherein said first titanium alloy has a Young's modulus of 120 to 150 GPa and a tensile strength of 950 to 2,200 MPa.

18. The golf club head of claim 17, wherein said second titanium alloy has a Young's modulus of 100 to 120 GPa and a tensile strength of 900 to 1,200 MPa, and a ratio e1/e2 of the Young's modulus e1 of said first titanium alloy to the Young's modulus e2 of said second titanium alloy is from 1.0 to 1.50.

19. The golf club head of claim 17, wherein said second titanium alloy has a Young's modulus of 100 to 120 GPa and a tensile strength of 900 to 1,200 MPa, and a ratio S1/S2 of the tensile strength S1 of said first titanium alloy to the tensile strength S2 of said second titanium alloy is from 1.05 to 1.35.

20. The golf club head of claim 14, wherein said first titanium alloy comprises 4.5 to 5.5% by weight of aluminum, 0.5 to 1.5% by weight of iron, and the rest of titanium and unavoidable impurities.

21. The golf club head of claim 14, wherein said second titanium alloy has a specific gravity of at most 4.51.

22. The golf club head of claim 14, wherein a ratio sg1/sg2 of a specific gravity sg1 of said first titanium alloy to a specific gravity sg2 of said second titanium alloy is 0.95 or more.

23. The golf club head of claim 14, wherein said second titanium alloy has a Young's modulus of 100 to 120 GPa and a tensile strength of 900 to 1,200 MPa.

24. The golf club head of claim 14 , wherein said first titanium alloy is a Ti—Al—Fe alloy.

25. The golf club head of claim 14, wherein said first titanium alloy is Ti-5Al-1Fe alloy.

26. The golf club head of claim 25, wherein said second titanium alloy is a member selected from the group consisting of Ti-6Al-4V, Ti-3Al-2.5V, Ti-4.5Al-2Mo-1.6V-0.5Fe-0.3Si-0.03C, Ti-4.5Al-4Cr-0.5Fe-0.2C, Ti-4.5Al-2Cr-1Mo-1.3V-0.5Fe-0.15C, Ti-4.5Al-3V -2Fe-2Mo, Ti-1Fe-0.35O, Ti-5Al-2Fe-3Mo, and Ti-6Al-1Fe.

27. The golf club head of claim 14, which has a depth of the center of gravity of 23 to 27 mm.

28. The golf club head of claim 14, wherein said club head comprises a head body and a face member which constitutes a main part of said face portion and is fixed to said head body, in which said face member is made of a first titanium alloy and said head body is made of a second titanium alloy having a larger specific gravity than that of said first titanium alloy.

* * * * *